United States Patent [19]

Otsuka

[11] 4,370,960

[45] Feb. 1, 1983

[54] ENGINE SPEED CONTROL SYSTEM

[75] Inventor: Kazutoshi Otsuka, Hiroshima, Japan

[73] Assignee: Toyo Kogyo Co., Ltd., Hiroshima, Japan

[21] Appl. No.: 204,252

[22] Filed: Nov. 5, 1980

[30] Foreign Application Priority Data

Nov. 6, 1979 [JP] Japan ..... 54-144026

[51] Int. Cl.[3] ..... F02M 3/00

[52] U.S. Cl. ..... 123/339; 123/353; 123/360; 123/440; 123/585; 60/276

[58] Field of Search ..... 123/339, 352, 353, 360, 123/440, 489, 585; 180/176, 179; 60/276

[56] References Cited

U.S. PATENT DOCUMENTS

| | | | |
|---|---|---|---|
| 3,964,457 | 6/1976 | Coscia | 123/339 |
| 4,094,378 | 6/1978 | Scheyhing et al. | 123/352 |
| 4,137,877 | 2/1979 | Saito | 123/440 |
| 4,242,994 | 1/1981 | Keely | 123/339 |
| 4,291,656 | 9/1981 | Miyagi et al. | 123/339 |
| 4,300,501 | 11/1981 | Suzuki | 123/339 |

FOREIGN PATENT DOCUMENTS

| | | |
|---|---|---|
| 49-40886 | 11/1974 | Japan . |
| 54-73417 | 5/1979 | Japan . |

*Primary Examiner*—Charles J. Myhre
*Assistant Examiner*—Andrew M. Dolinar
*Attorney, Agent, or Firm*—Wenderoth, Lind & Ponack

[57] ABSTRACT

An idle control system for an automobile internal combustion engine includes an idle control unit for controlling the operation of an electromagnetically operated actuator. While the engine has a combustible mixture intake passage leading to the engine and a throttle valve operatively positioned inside the mixture intake passage for controlling the flow of a combustible air-fuel mixture towards the engine, the actuator is utilized to adjust either the effective cross sectional area of a bypass air passage leading from the air source to the mixture intake passage at a position downstream of the throttle valve or the opening of the throttle valve, to control the engine speed during idling to a predetermined value.

4 Claims, 7 Drawing Figures

ENGINE SPEED CONTROL SYSTEM

BACKGROUND OF THE INVENTION

The present invention generally relates to an engine speed control system and, more particularly, to a control system for controlling the engine speed during idling to a predetermined engine speed.

In spite of various conditions surrounding the automobile internal combustion engine such as change in load applied to the engine, change in density of the atmospheric air, the degree of lapping of the engine, and variation in the engine tolerances or the like, there is a requirement for maintaining the engine speed at a predetermined value. Stable engine speed is becoming important in that the engine speed during idling is required to be made lower to reduce fuel consumption and the emission of noxious components of exhaust gases to the atmosphere during idling of the engine.

One type of known automobile idle control device includes an electrically operated actuator for adjusting the engine idling speed by varying the effective area of a bypass air passage leading to a fuel intake passage at a position downstream of the throttle valve. The idle control device also has a speed detector for detecting the engine idling speed and a control circuitry for receiving an output signal from the speed detector and operating the actuator when the engine speed during idling deviates from the predetermined value, thereby correcting the idling speed to the predetermined value.

For example, the Japanese Patent Publication No. 49-40886, published on Nov. 6, 1974, discloses an engine idle control device comprising an electrically operated actuator which varies the effective area of a bypass air passage having one end communicated to the atmosphere and the other end communicated to the fuel intake passage at a position downstream of the throttle valve; a tachometer for detecting the engine speed and generating an electric signal indicative of the actual engine speed detected; a reference voltage generator for generating a reference voltage corresponding to a desired or predetermined engine idling speed; a controlling circuit having a comparator for comparing the electric signal from the tachometer with the reference voltage; and means for operating the actuator to adjust the engine idling speed to the predetermined value when the difference is created between the electric signal from the tachometer and the reference voltage.

The Japanese Utility Model Laid-open Publication No. 54-73417, laid open to public inspection on May 25, 1979, discloses an apparatus similar to that disclosed in the first mentioned Japanese publication. To more accurately control the engine idling speed to the predetermined value, the actuator used in this Japanese publication is operated with a continuously repeating pulse signal so that the duty cycle of the actuator can be controlled. It is to be noted that the duty cycle referred to above is the ratio, expressed as a percentage, of the time during which an electric current is supplied to the solenoid of the actuator, relative to the unit time and that 0% duty cycle and 100% duty cycle stand respectively for the closure and full opening of the actuator.

According to the prior art, even during the stable idling of the engine with no change in the ambient conditions under which the engine is operated, the engine idling speeds tends to deviate from the predetermined value. To solve this problem, correction of the engine speed during idling performed when the ambient conditions under which the engine is operated changes, for example, by reason of an automobile air-conditioner being operated, to the predetermined engine speed requires a relatively long time. In other words, the system response to a change in engine speed is slow. Conversely, if attempt is made to improve the system response characteristic, the stability of the engine speed is adversely affected.

On the other hand, the U.S. Pat. No. 4,137,877, patented Feb. 6, 1979, discloses an air-fuel ratio control circuitry which may be employed in the practice of the present invention.

SUMMARY OF THE INVENTION

Accordingly, the present invention has been made with a view to substantially eliminate the disadvantages and inconveniences inherent in the prior art engine idle control system and is intended to provide an improved engine idle control system which is reliable in operation and quick in its response characteristics.

Another important object of the present invention is to provide an improved engine idle control system which is effective to control the engine idling speed to a predetermined value accurately and quickly once the engine idling speed deviates from the predetermined value.

According to the present invention, there is provided an engine idle control system for an automobile internal combustion engine comprising a source of combustible air-fuel mixture, a mixture intake passage means for supplying the combustible mixture from the mixture source to the engine, and exhaust passage means through which exhaust gases formed in the engine as a result of combustion of the combustible mixture are discharged to the atmosphere. The engine idle control system comprises an actuator means which may comprise a solenoid for controlling the engine speed to a predetermined value, a speed sensor for detecting the engine speed and generating an electric output signal indicative of the actual engine speed, a control means connected to the speed sensor and the actuator for receiving the electric output signal from the speed sensor and operating the actuator to maintain the engine speed during idling at the predetermined value, said control means having a first means for determining the duty cycle during which the solenoid of the actuator means is electrically energized within a given period of time to cause the actuator means to control the engine speed in response to its input signal, a second means for comparing the electric output signal from the speed sensor with a reference signal representative of the predetermined engine speed and generating a difference signal indicative of the difference between the actual engine speed and the predetermined engine speed, a third means for detecting the magnitude of change occurring in the electrical output signal from the speed sensor and generating an output signal only when said magnitude of change exceeds a predetermined value, and a fourth means for adding the difference signal and the electric output signal from the detecting means and generating an output signal indicative of the sum of the difference signal and the output signal indicative of the actual engine speed. The output signal from the fourth means is supplied to the first means as the input signal so that when the magnitude of change in engine speed is large, the difference signal is supplied, together with a compensating signal, to the first means to increase the change of the duty cycle, and when the magnitude of change is small, only the difference signal is supplied to the first means to decrease the change of the duty cycle. By so doing, the engine speed during idling can be maintained at the predetermined speed.

BRIEF DESCRIPTION OF THE DRAWINGS

These and other objects and features of the present invention will become apparent from the following description taken with reference to the accompanying drawings, in which.

DETAILED DESCRIPTION OF THE INVENTION

Figure 1:
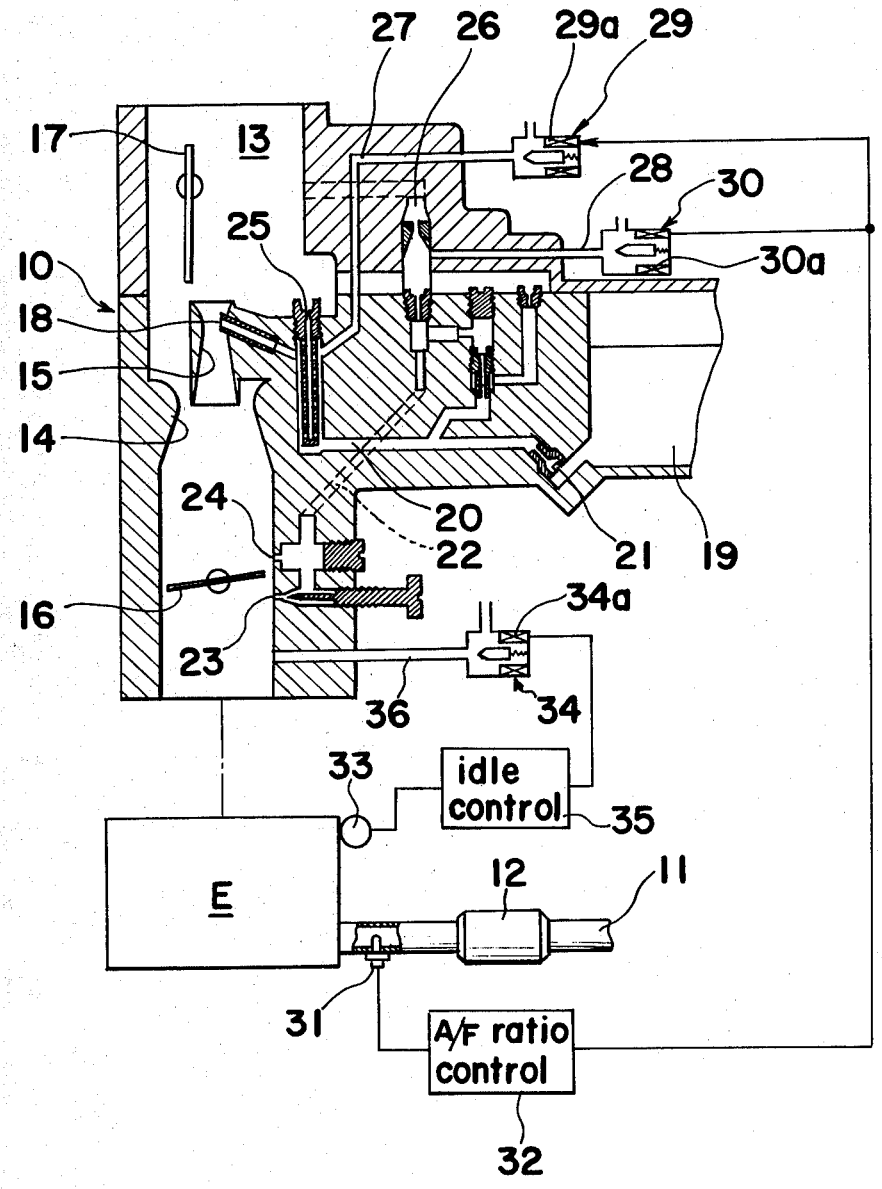
FIG. 1 is a schematic diagram showing a sectional view of an automobile internal combustion engine with an idle control system of the present invention incorporated therein.

Before the description of the present invention proceeds, it is to be noted that like parts designated by like reference numerals throughout the accompanying drawings.

Referring first to FIG. 1, there is shown an automobile power plant comprising an internal combustion engine E having a fuel intake system and an exhaust system. The fuel intake system includes a source of combustion air-fuel mixture, that is, a carburetor 10, while the exhaust system includes an exhaust duct 11 having a catalytic converter 12, for example, a three-way catalytic converter, installed thereon.

The carburetor 10 is of any known construction and includes a fuel intake passage 13 having one end communicated to the atmosphere through an air cleaner (not shown) and the other end fluid-connected to the engine E, a primary venturi 14, an auxiliary venturi 15, a pivotally supported throttle valve 16 positioned inside the fuel intake passage 13 downstream of the venturies 14 and 15 with respect to the direction of flow of combustible air-fuel mixture towards the engine E, a pivotally supported choke valve 17 positioned inside the fuel intake passage 13 and on one side of the venturies 14 and 15 opposite to the throttle valve 16, a fuel nozzle 18 opening through the hollow of the auxiliary venturi 15 into the fuel intake passage 13, a fuel bowl 19, a main fuel supply passage or high-speed fuel passage 20 having one end communicated to the fuel bowl 19 through a metering orifice 21 and the other end communicated to the fuel nozzle 18, an idle and low-speed fuel passage 22 leading from the fuel bowl 19 to idle and low-speed ports 23 and 24 both opening into the fuel intake passage 13 in the vicinity of the throttle valve 16 in a manner known to those skilled in the art, a high-speed air bleed 25 for introducing into the high-speed fuel passage 20 the air which is required to be premixed with the fuel before the latter is introduced into the fuel intake passage 13 through the fuel nozzle 18, an idle and low-speed air bleed 26 for introducing into the idle and low-speed fuel passage 22 the air which is required to be premixed with fuel before the latter is introduced into the fuel intake passage 13 through one or both of the idle and low-speed ports 23 and 24. The detailed construction and function of the carburetor 10 so far described are well known to those skilled in the art.

However, in accordance with the present invention, the carburetor 10 also includes first and second auxiliary air bleed passages 27 and 28 communicated at one end to a portion of the high-speed fuel passage 20 adjacent the high-speed air bleed 25 and a portion of the idle and low-speed fuel passage 22 adjacent the idle and low-speed air bleed 26, respectively. The other ends of the respective first and second auxiliary air bleed passages 27 and 28 are communicated to the atmosphere preferably through the air cleaner (not shown) via first and second actuators 29 and 30. Each of the first and second actuators 29 and 30 has a solenoid **29*a* and 30*a* and is capable of assuming an opened position, when the corresponding solenoid 29*a* or 30*a* is electrically energized, to permit the flow of air from the atmosphere through the corresponding passage 27 or 28 and a closed position during the deenergization of the corresponding solenoid 29*a* or 30*a* to interrupt the flow of air from the atmosphere through the corresponding passage 27 or 28. These first and second actuators 29 and 30** are constituted by electromagnetically operated flow control valves so far illustrated.

The solenoids **29*a* and 30*a* of the respective first and second actuators 29 and 30 are electrically connected to a composition sensor 31 through an air-fuel ratio control unit 32. The composition sensor 31 may be of any known construction and is installed on a portion of the exhaust duct 11 between the engine E and the catalytic converter 12 for sensing, and generating an electric output signal indicative of, the concentration of exhaust gases emitted from the engine E as a result of and subsequent to the combustion of the combustible air-fuel mixture in the engine E, it being understood that said concentration of the exhaust gas component is a function of the air-fuel mixing ratio of the combustible mixture which has been burned in the engine E. While the details of the air-fuel ratio control unit 32 will be described later, the air-fuel ratio control unit 32 is so designed as to control the operation of both of the first and second actuators 29 and 30 during normal operating condition of the engine E and also during idling of the engine E in dependence on the concentration of the exhaust gas component sensed by the composition sensor 31**, so that the air-fuel mixing ratio of the combustible mixture can be adjusted to a stoichiometric value.

More specifically, during the engine idling with the throttle valve 16 substantially closed, the second actuator 30 is so controlled as to increase the amount of air flowing towards the idle and low-speed fuel passage 22 through the second air passage 28 in the event that the sensed concentration of the exhaust gas component has shown that the air-fuel mixing ratio of the combustible mixture burned in the engine E was lower than the stoichiometric value, and also to decrease the amount of air flowing towards the idle and low-speed fuel passage 22 through the second air passage 28 in the event that the sensed concentration of the exhaust gas component has shown that the air-fuel mixing ratio of the combustible mixture burned in the engine E was higher than the stoichiometric value. It is to be noted that, during the engine idling, the high-speed fuel system including the high-speed fuel passage 20 and the fuel nozzle 18 is inoperative and, therefore, the first actuator 29, even though controlled simultaneously with the second actuator 30, does not participate in the adjustment of the air-fuel mixing ratio.

On the other hand, during the normal operating condition of the engine E with the throttle valve 16 opened, the first actuator 29 is so controlled as to increase the amount of air flowing towards the high-speed fuel passage 20 through the first air passage 27 in the event that the sensed concentration of the exhaust gas component has shown that the air-fuel mixing ratio of the combustible mixture burned in the engine E was lower than the stoichiometric value, and also to decrease the amount of air flowing towards the high-speed fuel passage 20 through the first air passage 27 in the event that the sensed concentration of the exhaust gas component has shown that the air-fuel mixing ratio of the combustible mixture burned in the engine E was higher than the stoichiometric value.

In any event, each of the solenoids 29*a* and 30*a* of the respective first and second actuators 29 and 30 is electrically energized to open the corresponding actuator 29 or 30 in response to the application thereto of a drive signal from the air-fuel ratio control unit 32. The drive signal from the air-fuel ratio control unit 32 is in the form of a train of pulses, the duration of which varies from time to time so as to adjust the duty cycle of each of the first and second actuators 29 and 30, that is, the percentage of time that each actuator 29 and 30 is opened during a given period of time.

The internal combustion engine E has an engine speed detector or tachometer for detecting, and generating an output signal indicative of, the rotational speed of the engine E, that is, the engine speed. For this purpose, the tachometer is preferably of a type capable of detecting the frequency of recurrence of ignition pulses generated per unit time in the primary coil built in an ignition distributor of any known automobile ignition system, said frequency of pulse recurrence being a function of the engine speed. This tachometer 33 is electrically connected to a solenoid 34*a* of a third actuator 34 through an idle control unit 35, the details of said idle control unit 35 being described later. The third actuator 34 similar in construction and function to any one of the first and second actuators 29 and 30 is capable of assuming an opened position, when the solenoid 34*a* is electrically energized, to permit the flow of air from the atmosphere through a bypass air passage 36 having one end communicated to the atmosphere preferably through the air cleaner and the other end communicated to the fuel intake passage 13 at a position downstream of the throttle valve 16, and a closed position during the deenergization of the solenoid 34*a* to interrupt the flow of air through the bypass air passage 36. As will become clear from the subsequent description, the idle control unit 35 is so designed as to control the operation of the third actuator 34 in dependence on the output signal from the tachometer 33. More specifically, the idle control unit 35 is so designed as to cause the third actuator 34 to increase the amount of air to be supplied into the fuel intake passage 13 through the bypass air passage 36 when the engine speed detected is lower than a predetermined value, and also to cause the third actuator 34 to decrease the amount of air to be supplied into the fuel intake passage 13 through the bypass air passage 36 when the engine speed detected is higher than the predetermined value, so that the engine speed can be maintained substantially at the predetermined value. For this purpose, the solenoid 34*a* of the third actuator 34 is electrically energized to open the actuator 34 in response to the application thereto of a drive signal from the idle control unit 35, which is in the form of a train of pulses, the duration of which varies from time to time so as to adjust the duty cycle of the third actuator 34, that is, the percentage of time that the third actuator 34 is opened during a given period of time.

Figure 2:
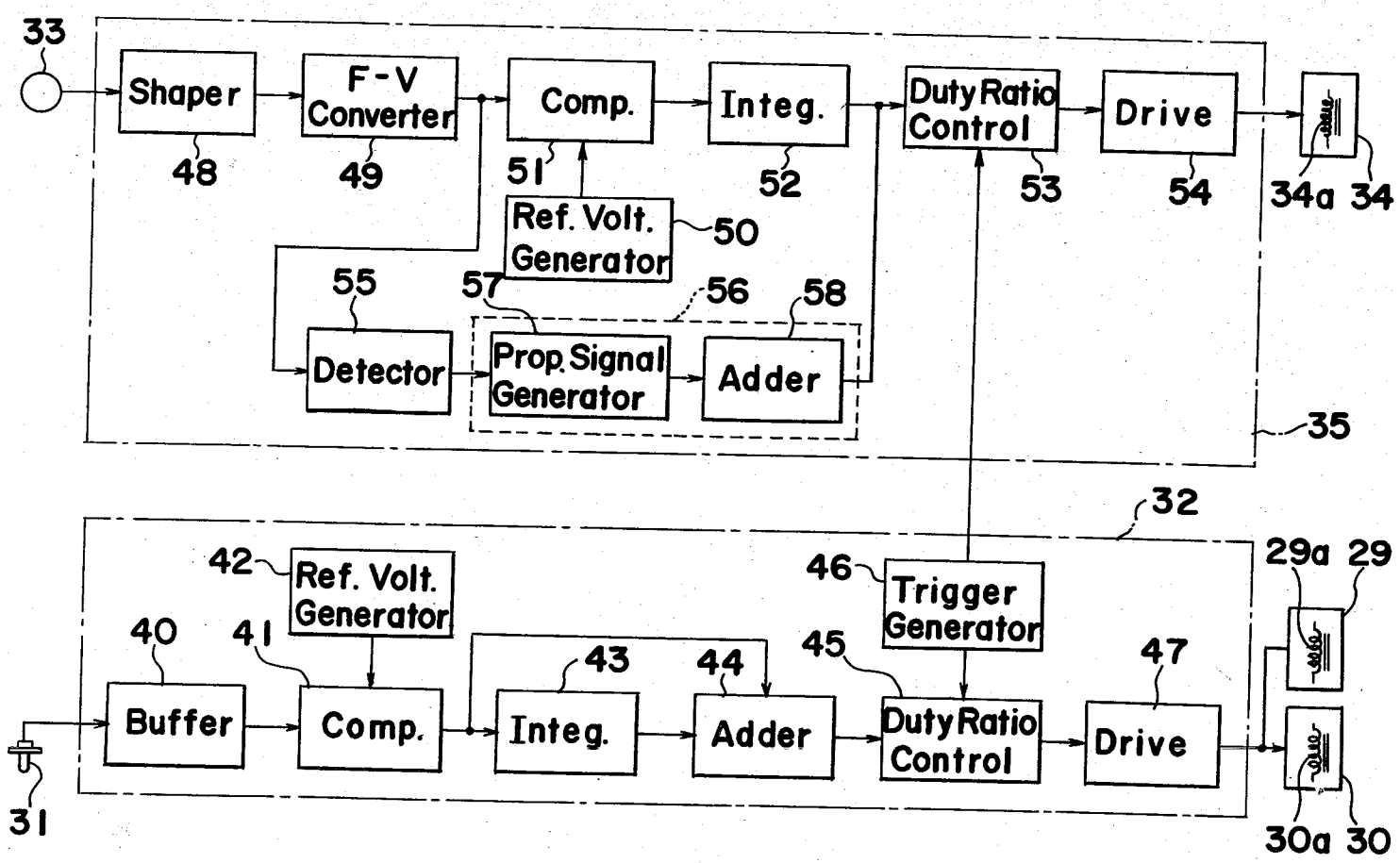
FIG. 2 is a circuit block diagram of the idle control system.

Referring now to FIG. 2, there is shown a circuit block diagram showing circuit components of the air-fuel ratio control unit 32 and the idle control unit 35. As shown therein, the air-fuel ratio control unit 32 comprises a buffer circuit 40 for amplifying and buffering the output signal from the composition sensor 31; a comparator circuit 41 for comparing an output signal from the buffer circuit 40 with a reference voltage which is representative of the stoichiometric air-fuel mixing ratio and which is fed from a reference voltage generator 42 and for generating a difference signal indicative of the difference in potential between the output signals from the respective circuits 40 and 42; an integrator circuit 43 for generating an output signal which is the time integral of the difference signal applied thereto from the comparator circuit 41; an adder circuit 44 for adding the output signal from the integrator circuit 43 and the difference signal from the comparator circuit 41; a duty ratio control circuit 45 adapted to be triggered on by a trigger pulse, fed from a trigger pulse generator 46, for generating a train of pulses; and a drive circuit 47 operable in response to the pulses from the duty ratio control circuit 45 for generating the drive signal necessary to energize the solenoids 29*a* and 30*a* of the respective first and second actuators 29 and 30. The details of each of the circuit components of the air-fuel ratio control unit 32 including the trigger pulse generator 46 are best shown in FIG. 5.

Figure 5:
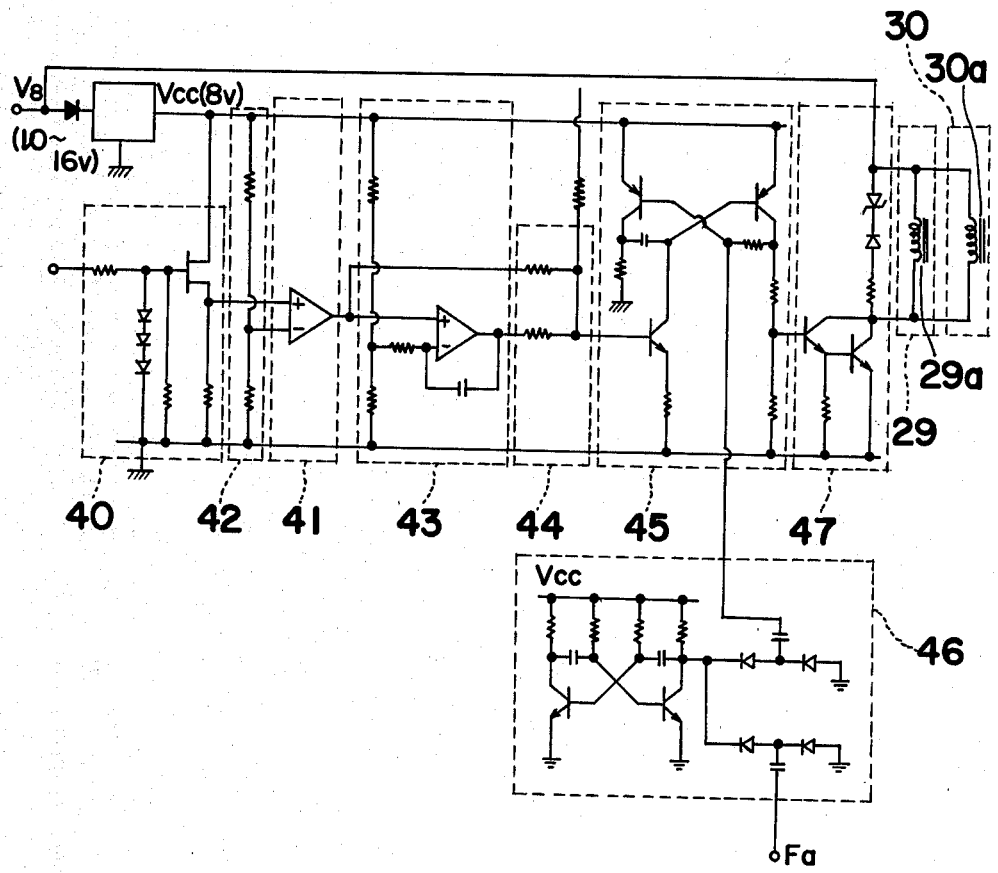
FIG. 5 is a detailed circuit diagram of an air-fuel ratio control unit used in the system of FIG. 2.

Referring to FIG. 5, the trigger pulse generator 46 comprises an oscillator capable of generating a train of recurrent pulses, the frequency of recurrence of the pulses being of a value within the range of 20 to 40 Hz.

A circuit block diagram of the idle control unit 35 is also shown in FIG. 2. This idle control unit 35 comprises a shaping circuit 48 for shaping the ignition pulses from the tachometer 33 into a train of recurring pulses of uniform waveform; a frequency-voltage converter 49 for generating an output signal, the voltage of which is proportional to the frequency of recurrence of the pulses from the shaping circuit 48; a reference voltage generator 50 for generating a reference signal of a voltage corresponding to a predetermined engine speed; a comparator circuit 51 for comparing an output signal from the frequency-voltage converter 49 with the reference signal from the reference voltage generator 50 and generating a difference signal indicative of the difference between the voltage of the output signal from the converter 49 and that of the reference signal from the generator 50; an integrator circuit 52 for generating an integrated output signal, the voltage of which is the time integral of the difference signal from the comparator circuit 51; a duty ratio control circuit 53 adapted to be triggered on by the trigger pulse, applied thereto from the trigger pulse generator 46, for generating a train of pulses; and a drive circuit 54 operable in response to the pulses from the duty ratio control circuit 53 for generating the drive signal necessary to energize the solenoid 34*a* of the third actuator 34.

The idle control circuit 35 further comprises a deviation detector circuit 55 having an input terminal connected to the frequency-voltage converter 49 and an output terminal connected to the duty ratio control circuit 53 through a proportionating signal generating circuitry 56. As will be described later in details, the deviation detector 55 is so designed as to detect from the output signal of the converter 49 the extent to which deviation has taken place in the engine speed. The proportionating signal generating circuitry 56 includes a proportionating signal generator 57 so designed as to compare the actual extent of deviation of the engine idling speed with a predetermined extent of deviation of the engine speed and to generate a proportionating signal when the extent of increase of the engine speed and the extent of decrease of the engine speed are higher than the predetermined value, and a phase-synchronized adder 58 for adding the proportionating signal from the generator 57 to the integrated output signal from the integrator circuit 52. It is to be noted that the circuitry including the detector 55, the generator 57 and the adder 58 serves to detect the variation of the engine speed when it has taken place suddenly and to add the proportionating signal to the integrated output signal from the integrator circuit 52 for the purpose of controlling the duty ratio according to the engine speed. However, where the variation of the engine speed so detected is small, the circuitry including the detector 55, the generator 57 and the adder 58 does not generate any proportionating signal and serves as a compensator circuit capable of performing compensation.

Figure 3:
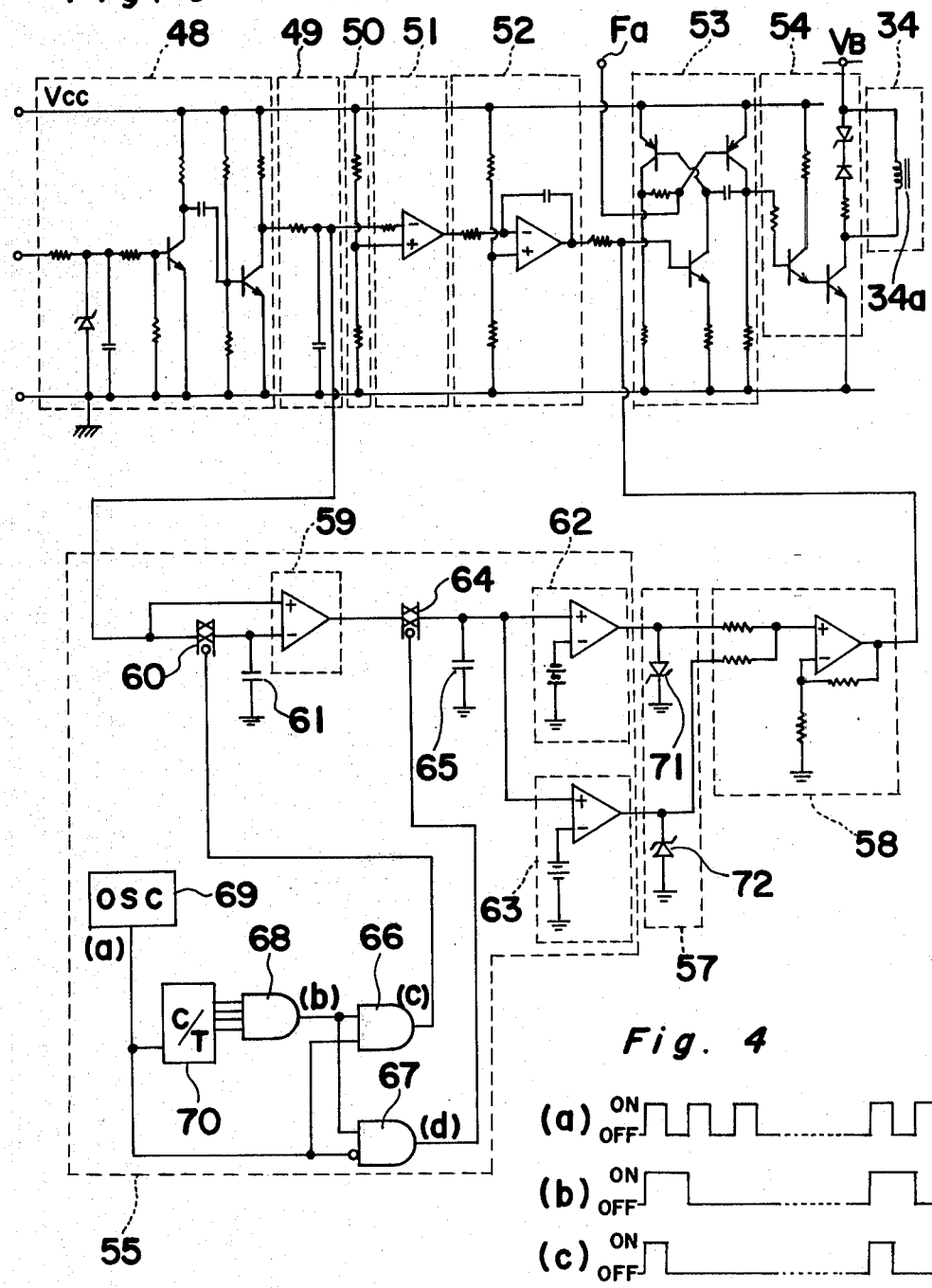
FIG. 3 is a detailed circuit diagram of the idle control unit used in the system of FIG. 2.

The details of each of the circuit components 48 to 54 of the idle control unit 35 are best shown in FIG. 3. Referring now to FIG. 3, the duty ratio control circuit 53 comprises a monostable multivibrator operable in response to the trigger pulse from the trigger pulse generator 46 to apply a train of pulses of different pulse width to the drive circuit 54. Specifically, the width of each pulse applied from the duty ratio control circuit 53 to the drive circuit 54 is determined by the voltage appearing at the input terminal of the duty ratio control circuit 53 to which both the integrator circuit 52 and the adder 58 are connected, and is large and small when the voltage appearing at said input terminal is low and high, respectively.

The deviation detector 55 comprises a first comparator 59 having a non-inverting input terminal adapted to receive the output signal from the frequency-voltage converter 49 and an inverting input terminal connected to the converter 49 through a first analog switch 60 and a first holding capacitor 61; and second and third comparators 62 and 63 connected at a non-inverting input terminal to an output terminal of the first comparator 59 through a second analog switch 64 and a second holding capacitor 65. The first and second analog switches 60 and 64 are respectively connected to first and second "AND" gates 66 and 67 which are in turn connected at one input terminal to a third "AND" gate 68 and at the other input terminal to an oscillator 69, the third "AND" gate 68 being in turn connected to the oscillator 69 through a counter 70. The oscillator 69, the third "AND" gate 68, the first "AND" gate 66 and the second "AND" gate 67 generate respective trains of pulses of the waveforms shown by (a), (b), (c) and (d) in FIG. 4.

Figure 4:
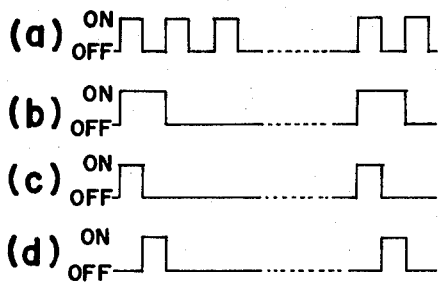
FIG. 4 is a diagram showing waveforms of pulses appearing in the circuit shown in FIG. 3.

As best shown in FIG. 4, the train of pulses (c) emerging from the first "AND" gate 66 have a phase opposite to the train of pulses (d) emerging from the second "AND" gate 67, so that when each pulse from the first "AND" gate 66 assumes a high level state, the pulses from the second "AND" gate 67 are in a low level state, and vice versa. Accordingly, the first and second analog switches 60 and 64 which receive the respective trains of pulses (c) and (d) from the first and second "AND" gates 66 and 67 are switched on or activated at different times, that is, alternately. Therefore, when the first analog switch 60 is switched on while the second analog switch 67 is off, the output signal from the frequency-voltage converter 49, the voltage of which is proportional to the engine speed, is charged on the first holding capacitor 61. The changed voltage on the first holding capacitor 61 is subsequently compared in the first comparator 59 with the voltage fed from the frequency-voltage converter 49 to the non-inverting input terminal of the first comparator 59 and, as a result thereof, the first comparator 59 generates an output signal indicative of the difference between the changed voltage on the first holding capacitor 61 and the voltage fed from the converter 49 when and after the second analog switch 64 has been switched on in response to the pulses from the second "AND" gate 67. In other words, the comparator 59 compares the voltage from the frequency-voltage converter 49 obtained at one particular moment with that obtained at the next succeeding moment to detect whether the voltage from the converter 49 is increasing or whether the voltage from the converter 49 is decreasing. Accordingly, the difference signal from the first comparator 59 may take either positive-going and negative-going states depending on whether the engine speed is increased or whether the engine speed is decreased, respectively, and is indicative of the occurrence of deviation of the engine speed, the extent of deviation of said engine speed being represented by the magnitude of the voltage of the difference signal.

The difference signal from the first comparator 59 is then supplied to the non-inverting input terminals of the respective second and third comparators 62 and 63. However, since the inverting input terminal of the second comparator 62 is fed with a predetermined negative voltage corresponding to a first permissible magnitude of deviation of the engine speed in a decreasing direction, the second comparator 62 serves to compare only the negative-going difference signal from the first comparator 59 with the predetermined negative voltage and to generate a negative-going difference signal indicative of the difference between the voltage indicative of the actual extent of deviation of the engine speed and the predetermined negative voltage only when the actual extent of deviation of the engine speed in the decreasing direction exceeds the permissible magnitude of deviation of the engine speed represented by the predetermined negative voltage. On the other hand, since the inverting input terminal of the third comparator 63 is fed with a predetermined positive voltage corresponding to a second permissible magnitude of deviation of the engine speed in an increasing direction, the third comparator 63 serves to compare only the positive-going difference signal from the first comparator 59 with the predetermined positive voltage and to generate a positive-going difference signal indicative of the difference between the voltage indicative of the actual extent of deviation of the engine speed and the predetermined positive voltage only when the actual extent of deviation of the engine speed in the increasing direction exceeds the permissible magnitude of deviation of the engine speed represented by the predetermined positive voltage.

The difference signals from the respective second and third comparators 62 and 63 are then supplied one at a time to the phase-synchronized adder 58 through the proportionating signal generating circuit 57. In the proportionating signal generating circuit 57, the negative-going difference signal from the second comparator 62 is applied to the adder 58 in the form of a proportionating signal the voltage of which is determined by a limiter diode 71 which is constituted by a Zener diode. On the other hand, the positive-going difference signal from the third comparator 63 is applied to the adder 58 in the form of a proportionating signal the voltage of which is determined by a limiter diode 72. The proportionating signal emerging from the adder 58 is in turn added to the integrated output signal from the integrator circuit 52 which is being supplied to the duty ratio control circuit 53.

While the system of the present invention is constructed as hereinbefore described, it operates in the following manner.

Assuming that the engine speed during idling, that is, the engine idling speed, decreases below a predetermined value, the output voltage from the frequency-voltage converter 49 is correspondingly reduced below the predetermined voltage and, accordingly, the comparator circuit 51 generates a high level signal. Upon receipt of this high level signal from the comparator circuit 51, the integrator circuit 52 generates an output signal the voltage of which is the time integral of the high level signal from the comparator 51. The integrated output signal from the integrator circuit 52 being in turn applied to the duty ratio control circuit 53 to cause the latter to generate a pulse the duty cycle of which increases with time. The pulse from the duty ratio control circuit 53 is then applied to the drive circuit 54 to trigger the latter and, as a result thereof, the drive circuit 54 generates the drive signal necessary to energize the solenoid 34*a* of the third actuator 34 for a period of time determined by the duty cycle of the pulse applied to the drive circuit 54. Upon energization of the solenoid 34*a*, the third actuator 34 is held in the opened position to increase the amount of air drawn from the atmosphere into the fuel intake passage 13 through the bypass air passage 36, whereby the engine speed once decreased is increased to the predetermined engine speed.

Where the extent of deviation of the engine speed in the decreasing direction is of a value exceeding the first permissible magnitude of deviation represented by the predetermined negative voltage applied to the inverting input terminal of the second comparator 62, the proportionating signal emerging from the proportionating signal generating circuit 57 is added to the integrated output signal from the integrator circuit 52 and, accordingly, the duty cycle of the pulse being produced from the duty ratio control circuit 53 is increased so that the duty cycle of the third actuator 34 is correspondingly increased as compared with the duty cycle relied solely on the integrated output signal from the integrator circuit 52. By so doing, the amount of air drawn from the atmosphere into the fuel intake passage 13 through the bypass air passage 36 by way of the third actuator 34 is further increased, thereby improving the response characteristic of the system to variation in engine speed.

Figure 6:
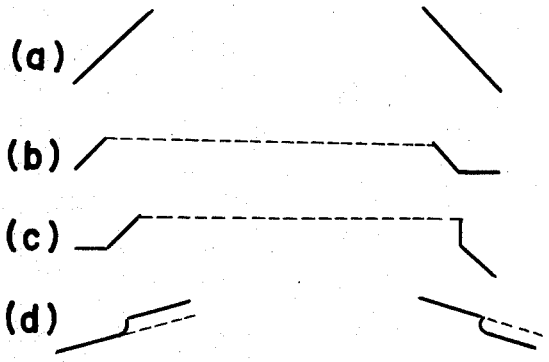
FIG. 6 is a diagram showing waveforms of signals appearing in the circuit shown in FIG. 3.

With reference to FIG. 6, particularly, the right-hand portion of FIG. 6, the output voltage from the converter 49, the waveform of which is shown by waveform (a) in FIG. 6, is charged on the first and second holding capacitors 61 and 65 at different times, the waveforms of the voltages charged respectively on the first and second holding capacitors 61 and 65 being shown by waveforms (b) and (c) in FIG. 6. The voltages of the waveforms (b) and (c) shown in FIG. 6 and charged respectively on the first and second holding capacitors 61 and 65 are compared, the difference of which is then supplied to the second comparator 62. The proportionating signal referred to above is indicative of the difference between the predetermined negative voltage fed to the inverting input terminal of the second comparator 62 and the voltage indicative of the difference fed from the first comparator 59. This proportionating signal is in turn fed to the duty ratio control circuit 53 together with the integrated output signal from the integrator circuit 52 as shown by waveform (d) in FIG. 6.

As hereinabove described, since the amount of air to be supplied into the fuel intake passage 13 through the bypass air passage 36 is increased when the engine speed decreases, the air-fuel mixing ratio of the combustible mixture being supplied to the engine E is increased to a value higher than the stoichiometric value and, accordingly, the output voltage from the composition sensor 31 correspondingly decreases. Accordingly, the comparator circuit 41 in the air-fuel ratio control unit 32 generates a low level signal. The integrator circuit 43 in the air-fuel ratio control unit 32, upon receipt of the low level signal from the comparator circuit 41, generates an integrated output signal the voltage of which is the time integral of the voltage of the low level signal from the comparator circuit 41. The integrated output signal from the integrator circuit 43 is then added in the adder circuit 44 with the voltage from the comparator circuit 41. The duty ratio control circuit 45 is controlled in accordance with the output signal from the adder circuit 44. The duty cycle of the output pulse from the duty ratio control circuit 45 is sharply decreased in correspondence with the set-down of the output of the comparator 41 from the high level state to the low level state and, thereafter, decreases with time. Accordingly, when the drive circuit 47 is triggered by the pulses from the duty ratio control circuit 45, the drive circuit 47 generates the drive signal effective to reduce the duty cycle of the second actuator 30 to decrease the amount of air drawn from the atmosphere into the second auxiliary air passage 28 so that the amount of fuel to be supplied towards the ports 23 and 24 through the idle and low-speed fuel passage 22 can be increased. By so doing, the air-fuel mixing ratio of the combustible mixture being supplied to the engine E can be controlled to a value substantially equal to the stoichiometric value.

In the case where the engine idling speed exceeds the predetermined value, the system functions in a manner substantially reverse to that described above. More specifically, increase of the engine idling speed over the predetermined value results in increase of the output voltage from the frequency-voltage converter 49 over the predetermined voltage and, consequently, the duty cycle of the third actuator 34 is reduced to permit the reduction of the amount of air to be supplied into the fuel intake passage 13 through the bypass air passage 36 so that the engine idling speed can be adjusted to the predetermined value. However, where the extent of deviation of the engine speed in the increasing direction is of a value exceeding the second permissible magnitude of deviation represented by the predetermined positive voltage applied to the inverting input terminal of the third comparator 63, the proportionating signal emerging from the proportionating signal generating circuit 57 is added to the integrated output signal from the integrator circuit 52. Accordingly, in response to the signal indicative of the sum of the proportionating signal and the integrated output signal, the duty ratio control circuit 53 applies the pulse to the drive circuit 54, the duty cycle of the pulse from the duty ratio control circuit 53 being sharply decreased so that the duty cycle of the third actuator 34 can be decreased in a magnitude larger than the duty cycle relied solely on the integrated output signal from the integrator circuit 52. By so doing the amount of air drawn from the atmosphere into the fuel intake passage 13 through the bypass air passage 36 by way of the third actuator 34 is decreased, thereby improving the response characteristic of the system to variations in engine speed.

With reference to FIG. 6, particularly, the left-hand portion of FIG. 6, the output voltage from the converter 49, the waveform of which is shown by waveform (a) in FIG. 6, is charged on the first and second holding capacitors 61 and 65 at different times, the waveforms of the voltages charged respectively on the first and second holding capacitors 61 and 65 being shown by waveforms (b) and (c) in FIG. 6. The voltages of the waveforms (b) and (c) shown in FIG. 6 and charged respectively on the first and second holding capacitors 61 and 65 are compared, the difference therebetween being then supplied to the third comparator 63. The proportionating signal referred to above is indicative of the difference between the predetermined positive voltage feed to the inverting input terminal of the third comparator 63 and the voltage indicative of the difference fed from the first comparator 59 and is, prior to being fed to the duty ratio control circuit 53, added to the integrated output signal the waveform of which is shown by the broken line of waveform (d) in FIG. 6.

As hereinabove described, since the amount of air to be supplied into the fuel intake passage 13 through the bypass air passage 36 is decreased when the engine speed increases, the air-fuel mixing ratio of the combustible mixture being supplied to the engine E is decreased to a value lower than the stoichiometric value and, accordingly, the output voltage from the composition sensor 31 correspondingly increases. As a consequence, the duty cycle of the second actuator 30 is increased to permit the supply of air into the fuel intake passage 13 in an amount necessary to adjust the air-fuel mixing ratio of the combustible mixture to a value substantially equal to the stoichiometric value.

The engine idling speed can also be controlled to the predetermined value by adjusting the opening of the throttle valve 16. This will now be described with particular reference to FIG. 7.

Figure 7:
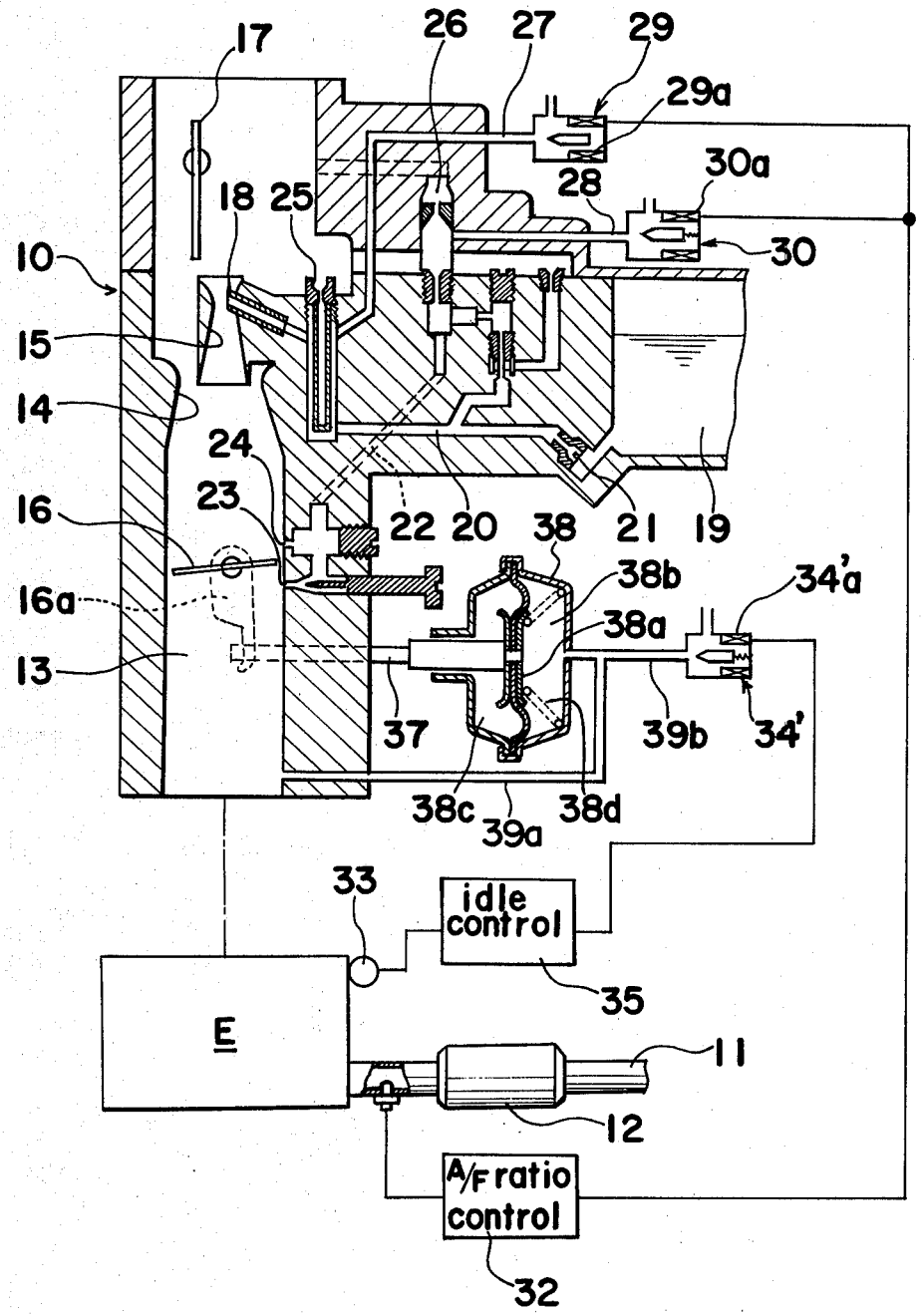
FIG. 7 is a diagram similar to FIG. 2, showing another embodiment of the present invention.

Referring now to FIG. 7, one external end of the pivot shaft on which the throttle valve 16 is rigidly mounted has a lever **16*a* rigidly connected thereto for rotation together therewith. This lever 16*a* is in turn engaged to an operating rod 37 supported for movement between first and second positions, it being to be understood that the throttle valve 16 is normally held in a substantially closed position as shown by the action of a biasing force unless an acceleration pedal installed inside an automobile vehicle is footed down. So far described, when the operating rod 37 is moved to the first position, the throttle valve 16 is held in the substantially closed position when the three end of the lever 16*a* in contact with the corresponding end of the rod 37, but when the rod 37 is moved towards the second position, the throttle valve 16 is pivoted to open with the end of the rod 37 moving in contact with the free end of the lever 37**.

For controlling the movement of the operating rod 37 in accordance with the drive signal from the idle control unit 35, there is employed a diaphragm valve assembly 38 comprising a valve casing having a diaphragm member **38*a* which divides the interior of the valve casing into vacuum and atmospheric chambers 38*b* and 38*c*. The diaphragm member 38*a* is rigidly connected to the end of the rod 37 opposite to the lever 16*a* and is normally biased by a spring element 38*d*, housed in the vacuum chamber 38*b*, to hold the rod 37 in the first position as shown. The vacuum chamber 38*b* of the diaphragm valve assembly 38 is fluid-connected to the fuel intake passage 13 through a vacuum passage 39*a* having one end communicated to the chamber 38*b* and the other end opening into the fuel intake passage 13 at a position downstream of the throttle valve 16. A portion of the vacuum passage 39*a* adjacent the valve assembly 38 is communicated to the atmosphere through a branch passage 39*b* by way of an actuator 34' identical in construction to the third actuator 34** employed in the foregoing embodiment.

The actuator 34' has a solenoid **34'*a* electrically connected to the output terminal of the idle control unit 35 and, more particularly, to the output terminal of the drive circuit 54 shown in FIGS. 2 and 3. It is to be noted that, since the embodiment shown in FIG. 7 requires the actuator 34' to be operated in a manner opposite to the third actuator 34 employed in the foregoing embodiment, the idle control unit 35 to be used in association with the actuator 34' must have an inverter (not shown) inserted between the duty ratio control circuit 53 and the drive circuit 54**.

From the foregoing, it is clear that when the engine speed is lower than the predetermined engine speed, the duty cycle of the actuator 34' becomes smaller and the amount of air to be supplied into the branch passage **39*b* decreases and, accordingly, vacuum in the vacuum chamber 38*b* becomes larger. When the vacuum in the vacuum chamber 38*b* becomes larger, the diaphragm member 38*a* is displaced rightwards as viewed in FIG. 7 with the operating rod 38 moved from the first position towards the second position. Therefore, the throttle valve 16 is opened to increase the engine speed to the predetermined value. On the other hand, where the engine speed is higher than the predetermined value, both of the actuator 34' and the diaphragm valve assembly 38** operate in a manner reverse to that described above.

From the full description of the present invention, it has now become clear that the engine speed during idling can be maintained at the predetermined value and that, once the engine speed during idling deviates from the predetermined value, the deviation can be corrected quickly. More specifically, where the extent of deviation of the engine idling speed is small, the integrated output signal from the integrator circuit 52 is utilized to control the third actuator 34 or 34'. However, the where the extent of deviation of the engine idling speed is large, both of the integrated output signal from the integrator circuit 52 and the proportionating signal from the proportionating signal generator circuitry 56 are utilized to control the third actuator 34 or 34' to quickly increase or decrease the amount of air to be supplied into the fuel intake passage 13 as compared with the amount of air supplied by controlling the third actuator relying solely on the integrated output signal from the integrator circuit 52.

Although the present invention has fully been described in connection with the preferred embodiments thereof with reference to the accompanying drawings, it is to be noted that various changes and modifications are apparent to those skilled in the art. Such changes and modifications are to be understood as included within the true scope of the present invention, unless they depart therefrom.

I claim:

1. An engine idle control system for an automobile internal combustion engine comprising a source of a combustible air fuel mixture, a mixture intake passage means for supplying said combustible mixture from said mixture source to said engine, and an exhaust passage means through which exhaust gases formed in said engine as a result of combustion of said combustible mixture are discharged to the atmosphere, said idle control system comprising an actuator means for controlling the engine speed to a predetermined value; a speed sensor for detecting the engine speed and for generating an electric output signal indicative of the actual engine speed; a control means connected to said speed sensor and said actuator means for receiving said electric output signal from said speed sensor and for operating said actuator means so as to maintain the engine speed during idling at said predetermined speed, said control means having a first means for generating a control signal for causing said actuator means to control the engine speed in response to an input signal to the first means, a second means for comparing said electric output signal from said speed sensor with a reference signal representative of said predetermined engine speed and for generating a difference signal indicative of the difference between the actual engine speed and said predetermined engine speed, a third means for detecting the magnitude of change occurring in said electric output signal from said speed sensor and for generating an output signal only when said magnitude of change exceeds a predetermined magnitude, wherein said detecting means includes a timer means for generating an output signal at a predetermined time interval and a comparator means for comparing said output signal generated by said speed sensor at a certain time with the output signal generated by said speed sensor when said predetermined time interval has passed beyond said certain time and for generating an output signal when the difference therebetween is higher than a predetermined value, and a fourth means for adding said difference signal and said electric output signal from said comparator means of said third means and for generating an output signal indicative of the sum of said difference signal and said electric output signal from said comparator means of said third means, said output signal from the fourth means being supplied to the first means as said input signal to the first means, whereby said control signal is changed so as to cause the operation of said actuator to be increased when the magnitude of detected change of the engine speed is large.

2. A system as claimed in claim 1, wherein said combustible mixture source includes a throttle valve operatively positioned inside said mixture intake passage means for regulating the flow of said combustible mixture towards said engine, and further comprising a bypass air passage having one end communicated to a source of air and the other end opening into said mixture intake passage means at a position downstream of the throttle valve with respect to the direction of flow of said combustible mixture towards said engine, said actuator means being operable to vary the effective cross sectional area of said bypass air passage.

3. A system as claimed in claim 2, further comprising a catalytic converter disposed on said exhaust passage means for substantially purifying said exhaust gases, a composition sensor positioned between said engine and said catalytic converter for detecting the concentration of a component of said exhaust gases flowing through said exhaust passage means, and a control means for controlling the flow of fuel towards the mixture intake passage means, said control means being controlled in dependence on the concentration of said exhaust gas component detected so as to maintain the air-fuel mixing ratio of said combustible mixture at a predetermined ratio.

4. A system as claimed in claim 1, wherein said combustible mixture source includes a throttle valve operatively positioned inside the mixture intake passage means for regulating the flow of the combustible mixture towards the engine, said actuator means being operable to adjust the opening of said throttle valve.

* * * * *